United States Patent [19]

Pennekamp

[11] 4,200,470

[45] Apr. 29, 1980

[54] METHOD AND APPARATUS FOR CLEANING AMPULES OR SIMILAR CONTAINERS

[75] Inventor: Ingbert Pennekamp, Crailsheim, Fed. Rep. of Germany

[73] Assignee: H. Strunck GmbH & Co. Maschinenfabrik, Köln-Ehrenfeld, Fed. Rep. of Germany

[21] Appl. No.: 949,929

[22] Filed: Oct. 10, 1978

[30] Foreign Application Priority Data

Oct. 20, 1977 [DE] Fed. Rep. of Germany ..... 2747044

[51] Int. Cl.[2] ..... B08B 3/04

[52] U.S. Cl. ..... 134/1; 134/25 R; 134/134; 134/184; 141/89

[58] Field of Search ..... 141/92, 89, 90, 91, 141/1; 134/1, 79, 133, 134, 184, 25 R, 30

[56] References Cited

U.S. PATENT DOCUMENTS 3,202,187 8/1965 Pechmann ..... 141/92

*Primary Examiner*—Houston S. Bell, Jr.

*Attorney, Agent, or Firm*—Edwin E. Greigg

[57] ABSTRACT

A method and apparatus is proposed for cleaning ampules or similar containers which includes the steps of rinsing, spraying, and drying and includes an ultrasonic generator for pre-treating the ampules prior to the aforementioned steps.

8 Claims, 8 Drawing Figures

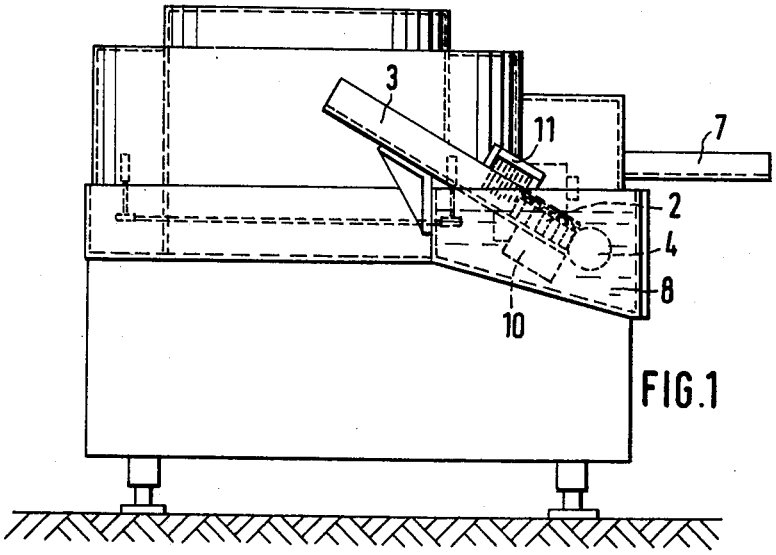
FIG.1
FIG.2
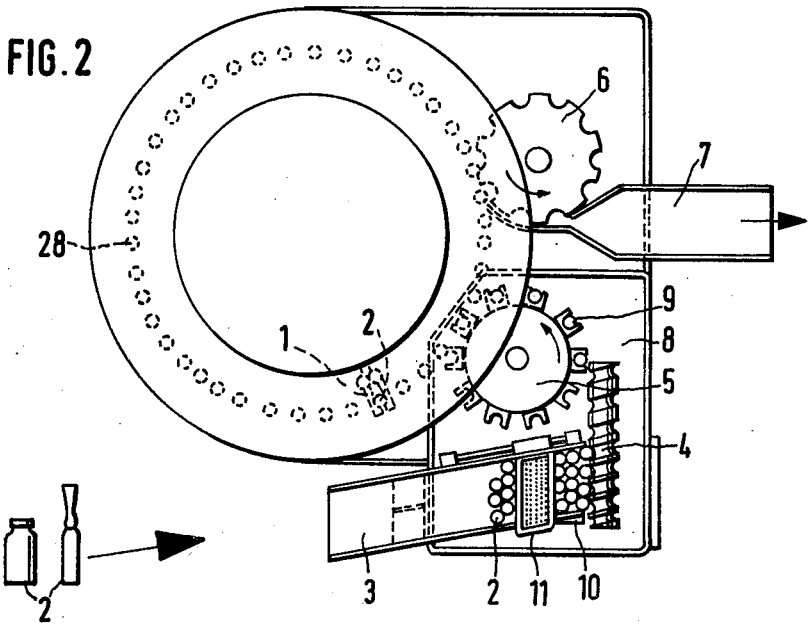

METHOD AND APPARATUS FOR CLEANING AMPULES OR SIMILAR CONTAINERS

BACKGROUND OF THE INVENTION

In order to be cleaned, ampules or similar containers are either placed on hollow needles, as is already known, for example, in the German laid-open application No. 20 24 205, or held by grasping elements fixed on revolving chains, as in the German laid-open application No. 19 01 833, and thus in this manner are delivered to the individual treatment stations. In both disclosures the delivery apparatus for the ampules is attached to a water bath subjected to ultrasonic waves, through which the ampules are guided. The ultrasonic treatment, in particular, removes firmly adhering dirt particles from the ampules. However, the portions of the ampules which are held by the grasping elements are not cleaned, and the areas which are beneath the grasping elements are likewise insufficiently reached by the ultrasonic waves. After the ultrasonic treatment, the ampules are sprayed several times on the inside and dried by blowing, and in the disclosure of the German laid-open application No. 20 24 205 they then proceed to the area of an apparatus which discharges them. In the apparatus according to the German laid-open application No. 19 01 833, a drying apparatus is connected to the spraying and blowing apparatus. Finally, the ampules are delivered to a removal station. In order to accomplish an effective ultrasonic treatment of the ampules, they must remain for a predetermined length of time in the water bath, and this interval is important, i.e., it must not be shortened. Thus the effectiveness of these cleaning machines is dependent on the length of time the ampules remain in the water bath which is subjected to ultrasonic waves. Furthermore, this teaching requires that the machines must be inordinately large for the purpose intended. Further, the fact that in these known machines the delivery station and the removal station adjoin each other relatively closely has also proved to be disadvantageous. An arrangement of the delivery and removal stations opposite each other was made possible for the machines in accordance with the German laid-open application No. 20 24 205 by having the ampules make a pass and a half through the machine before being discharged. However, then there is the disadvantage that in a certain area, clean ampules are located next to dirty ampules.

OBJECT AND SUMMARY OF THE INVENTION

In the method and apparatus according to this invention, the articles to be treated are subjected to ultrasonic waves immediately upon entry into the apparatus in a group and are also individually treated by the ultrasonics as they continue through the apparatus. Thus there is the advantage that by this teaching a relatively long period of time is available for the ultrasonic wave treatment of the ampules, since the ampules are already subjected to ultrasonic waves during the delivery operation and their separation through the machine, as well as partly during their further transfer. In the cleaning methods for ampules or the like which were previously known, the delivery, separation, and transfer of the ampules took place before the actual cleaning operation was initiated. Furthermore, this new method has the advantage of a very gentle handling of the ampules because they are delivered, separated, and transferred under water, since the water film between the ampules serves as a damping means, and the noise level as well is very significantly reduced. It has further been demonstrated that the effectiveness of the separation process is increased according to this teaching.

By means of the apparatus and method disclosed herein the advantage results above all that such cleaning machines can be much smaller and more compact, as well as more simply built, than was the case previously. In addition the apparatus disclosed herein can be made more amenable to inspection. Furthermore, it is advantageous that the ampules are not held by any kind of grasping elements or the like during the ultrasonic treatment, but rather are entirely freestanding, and thus their entire area can be well-cleaned.

It is further advantage of this invention that by means of rinsing off the ampules with the aid of the water shower and by means of the further advancement and separation of the ampules under water, a film forms between the inlet chute and the ampules, and between the drive device worm and the ampules, so that no difficulty arises in transporting the ampules by any element that would scratch or deface them. Further advantages are in the amenability of the apparatus to being serviced, in the simplicity of adjustment to other container sizes, and in the possibility of an in-line installation. The last-named advantage is possible in particular because in this apparatus, the delivery and removal stations are arranged opposite one another. The intensive showering of the ampules which has already been noted results in the further advantage that any glass breakage which may occur is rinsed away.

The invention will be better understood as well as further objects and advantages thereof become more apparent from the ensuing detailed description of preferred embodiments taken in conjunction with the drawings.

BRIEF DESCRIPTION OF THE DRAWINGS

FIG. 1 is a side elevational view of the cleaning apparatus according to the invention;

FIG. 2 is a top plan view of the apparatus of FIG. 1;

DESCRIPTION OF THE PREFERRED EMBODIMENTS

Figure 3:
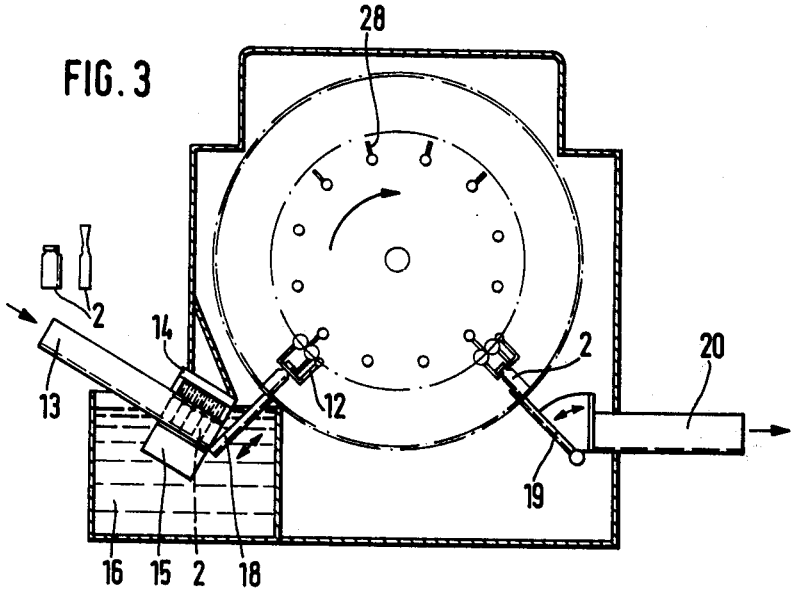
FIG. 3 is a side elevational view of a cleaning machine generally similar to that shown in FIGS. 1 and 2 but with a further modified delivery system.

As may be seen from FIGS. 1 and 2, the cleaning machine according to the invention is embodied as a continuous feeding means 1 in which tongs or gripper means are provided on a circular track, which serve to grasp and transport ampules or similar containers 2 through spraying and blowing stations which are per se known and will not be further described. These continuously rotating tongs 1 are associated with delivery means for the containers 2, which comprise substantially—as may best be seen in FIGS. 6 and 7—a delivery chute 3, a separation worm-like feeding device 4, and a rotary transfer apparatus 5. A removal station for the containers 2 is further associated with the circulating tong means 1 which comprises an exit conveyor wheel 6 and an exit chute 7 (see FIG. 2). The arrangement is further such that the delivery chute 3 is partly within a water bath 8 subjected to ultrasonic vibrations and the separation worm means 4 is entirely within the same water bath 8, while the rotary transfer apparatus 5 comprises individual pockets or supports 9 which follow a circular trackway, and further includes structure capable of traversing the containers through a serpentine path so that the container support means 9 travel down into and up out of the water bath 8 during the course of their travel. An ultrasonic generator 10 is positioned adjacent to one end of the delivery chute 3. Further, a means to provide a water shower 11 is arranged above the delivery chute 3, by the aid of which the containers 2 located within the delivery chute 3 are both rinsed off on the outside and filled with water as well.

The mode of operation is as follows:

The containers 2 delivered via the delivery chute 3 are rinsed off on the outside by the shower 11 and at the same time filled with water. Depending on the height of the containers 2, they are sooner or later entirely submerged in the water bath 8. At the same time, by means of the pressurized power of the shower rinse of the containers 2, any glass splinters or particles are washed away. With the aid of the worm drive means 4, the containers 2 are fed along individually and taken from the delivery chute 3 and are transferred to the container support means 9 of the transfer apparatus 5. During the transfer of the containers 2, the support means 9 therefor are still located in the water bath 8, and are then subsequently lifted in the course of the further transport of the containers 2, so that the support means 9 and containers 2 are located above the water bath 8 at which point the containers are transferred into the tongs 1. (See FIG. 7) After the transfer has taken place, the container support means 9 again dips down into the water bath 8, in order to pick up further containers 2 from the worm 4. The tongs 1 after receiving a container 2, are rotated about their length so that the openings of the containers 2 point downwards. Finally, the containers 2 are cleaned with water and air, whereby spraying elements which are per se known and will not be further described dip into the containers 2, move along with them, then are lowered and are finally moved back into their original position, in order to clean the next containers 2. After being sprayed out, the containers 2 are guided by the depressions provided in the exit conveyor wheel 6 so that they are fed into the discharge chute 7.

The side schematically shown in FIG. 3 of another embodiment of a cleaning machine likewise shows tongs 12 that travel through a circular path, with the circular path in this instance, however, being arranged to extend perpendicular to that of the exemplary embodiment shown in FIGS. 1 and 2. The delivery structure of this apparatus comprises an entry chute 13, which has a shower apparatus 14 associated therewith, and which further includes an ultrasonic generator 15 that is positioned beneath the chute 13 and in proximity to the lower end thereof. In this exemplary embodiment as well, the delivery chute 13 has a lower extremity that is located partially within a water bath 16 and is subjected to ultrasonic vibrations. The containers 2, which are rinsed off on the outside and filled with water by the shower 14, are pushed up into the circulating tongs 12 by means of an inserter slide 18, which is also arranged within the water bath 16. It is also to be understood that the upward movement of the containers 2 cause them to be pushed onto hollow needles 28 which are likewise circulating with the tongs 12 positioned in close proximity thereto. After passing through the spray apparatuses, which are known per se and not further described here, the containers 2 are guided with the aid of an ejector slide 19 into discharge chute 20.

Figure 4:
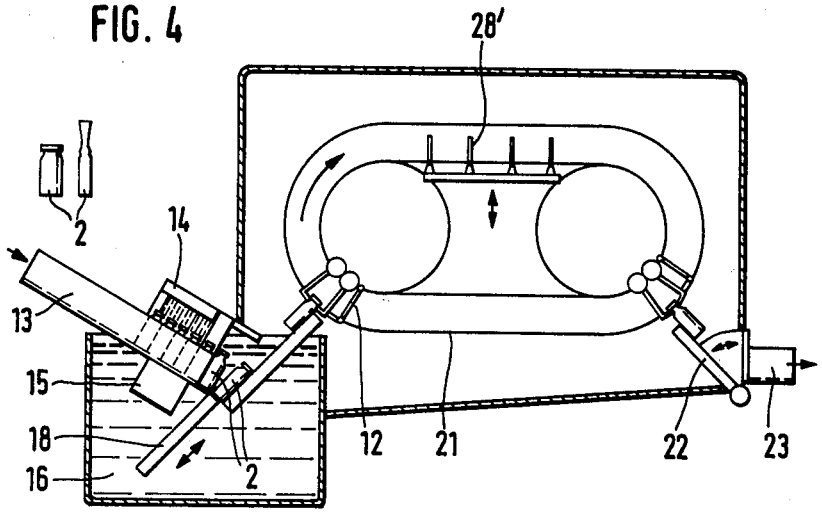
FIG. 4 is a side elevational view of another embodiment of a cleaning apparatus.

The apparatus represented in FIG. 4 has the same elements in the delivery area as does the apparatus of FIG. 3. Here, as well, the containers 2 are guided downwardly via the delivery chute 13 to a position adjacent to the inserter slide 18. The device for providing the shower 14 is likewise arranged above the delivery chute 13, and the ultrasonic generator 15 is provided in close proximity to the extremity of the delivery chute 13 as explained in connection with FIG. 3. The difference between this apparatus and that of FIG. 3 resides principally in that the tongs 12 of the cleaning apparatus shown in FIG. 4 are fixed on an endless revolving chain. The container discharge station, which is disposed opposite to the delivery station in this apparatus as well, comprises an ejector slide 22, which guides the containers 2 to discharge chute 23. The treatment of the containers 2 within the spray apparatuses takes place in a known manner as in the other machines. The chain 21 in this embodiment, however, may be so embodied in this machine that it is arranged to pass through a drying or sterilization tunnel, so that the cleaned containers 2 can finally be dried or sterilized. In such an apparatus where the additional steps referred to are provided for treatment of the containers the discharge station 22, 23 then is located in proximity to the drying or sterilization tunnel.

In the embodiment shown in FIG. 4, then, where the tongs 12 are mounted to circulate with the chain 21, the arrangement of the water bath 16 which is subjected to ultrasonic vibrations at the forward area of the machine results in the further advantage that the detours required in the previously described apparatus to transport the containers 2 into a water bath subjected to ultrasonic vibrations can be omitted.

Figure 5:
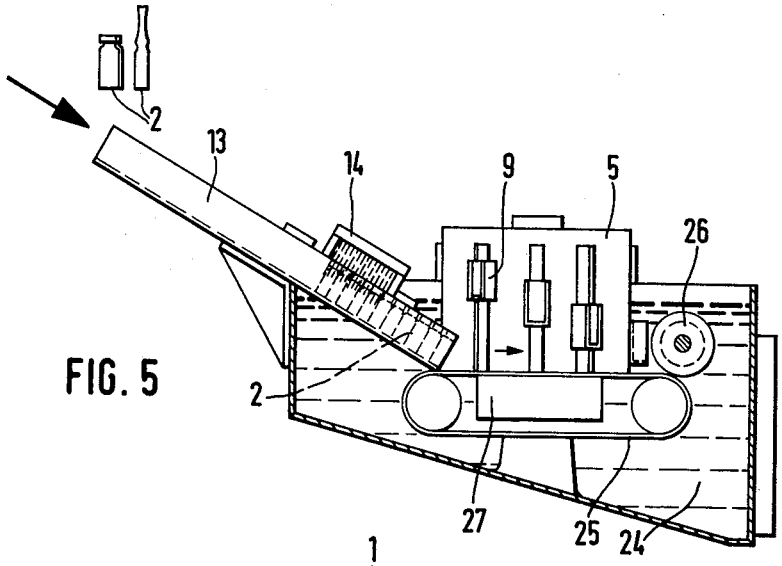
FIG. 5 is still another side elevational view of a further delivery system for ampules or similar containers.
Figure 6:
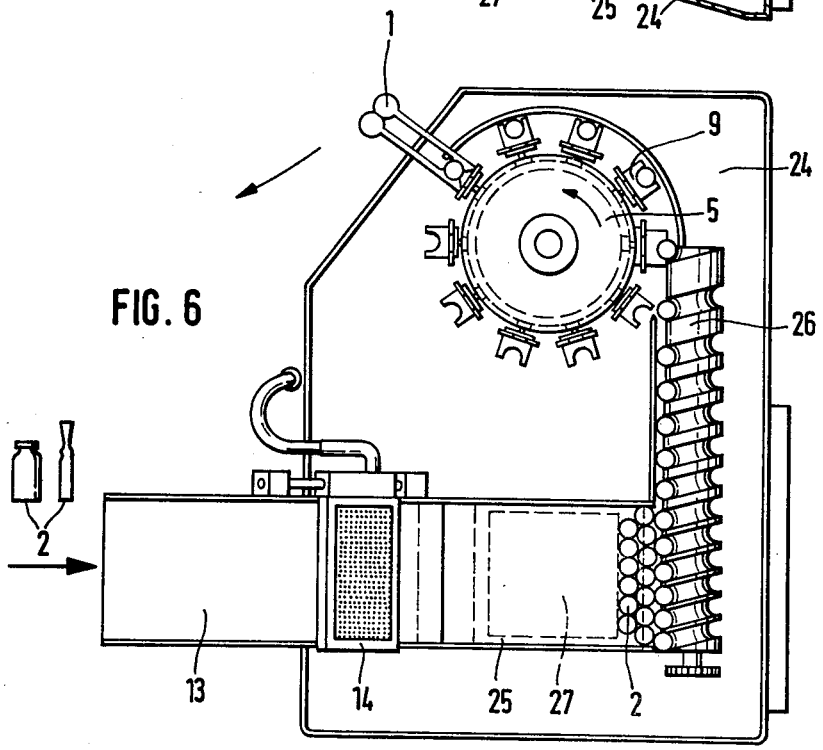
FIG. 6 is a top plan view of the apparatus of FIG. 5.
Figure 7:
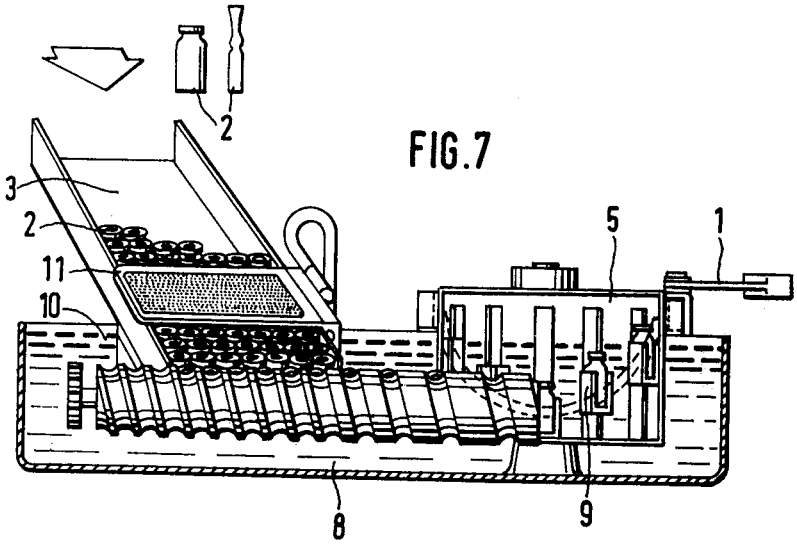
FIG. 7 is a side elevational view on a larger scale of the separation, advancement, and transfer of the containers in the water bath which is subjected to ultrasonic waves, in accordance with FIGS. 1 and 2.
Figure 8:
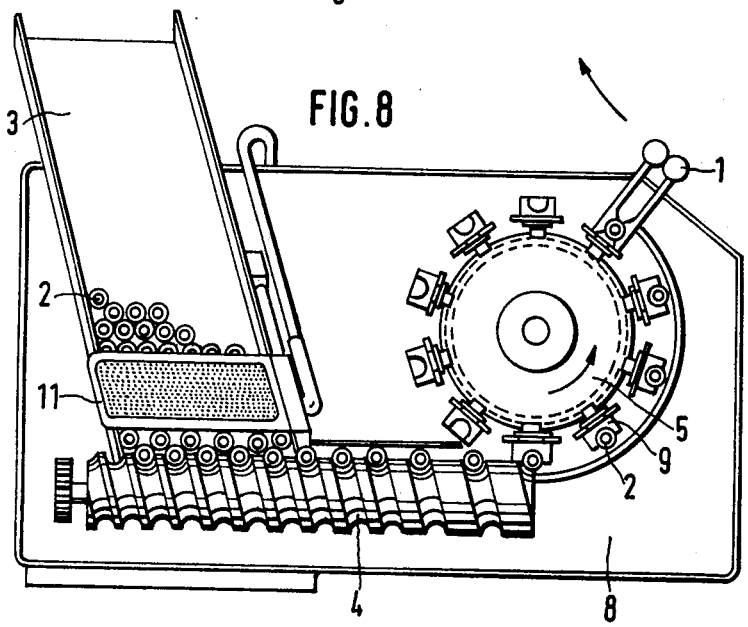
FIG. 8 is a plan view of the apparatus shown in FIG. 7.

In FIGS. 5 and 6, a further possibility for the delivery means for containers 2 is shown. The containers 2 are also as shown in this view delivered into the apparatus via a delivery chute 13 which is arranged to have a portion thereof extend downwardly into a water bath 24. In this embodiment as well, the shower 14 is located above the delivery chute 13. As shown in this view there is provided a receptacle which contains the water bath 24, an endless conveyor belt 25, a worm drive means 26 of the type described earlier herein, and a portion of the container transfer apparatus 5 which is provided with container support means 9. Below the conveyor belt 25, an ultrasonic generator 27 is located in the water bath 24. The arrangement of the conveyor belt 25 within the water bath 24 results in the advantage that the containers 2 can be guided to the worm drive means 26 in a compact, unordered stream, and thereby the period during which they remain within the water bath 24 subjected to the ultrasonic vibrations is greatly lengthened. Furthermore, this kind of delivery is particularly well-suited for large containers 2, since such containers are delivered to the worm drive means 26 standing in an upright position on the conveyor belt 25, and thus the possibility of their inadvertently being caused to fall into the worm drive means 26 is avoided. It is also to be understood that the possibility also exists that the containers 2, with the aid of this apparatus, may also be delivered in a single file, standing upright on the conveyor belt 25, to the worm drive means 26. The containers 2 are finally delivered, in the manner described with respect to the embodiment of FIGS. 1 and 2, to the support means 9 of the transfer apparatus 5 and then picked up seriatim by the tongs 1.

The foregoing relates to preferred embodiments of the invention, it being understood that other embodiments and variants thereof are possible within the spirit and scope of the invention, the latter being defined by the appended claims.

What is claimed is:

1. A method of cleaning ampules and similar containers comprising the steps of:

delivering a quantity of ampules to be cleaned;

rinsing said quantity of ampules;

submerging said quantity of ampules in a water bath;

subjecting said water bath to ultrasonic vibrations to ultrasonically clean said ampules in said water bath;

separating said ampules from each other in said water bath;

conveying said separated ampules out of said water bath;

spraying said separated ampules with a cleaning fluid; and blow drying said ampules subsequent to said spraying step.

2. An apparatus for cleaning ampules or similar containers in a water bath, comprising a receptacle provided with said water bath, means for subjecting said bath to ultrasonic waves and means disposed within said water bath for separating and for conveying said ampules during the cleaning thereof in said bath, further wherein said receptacle is provided with entry means or said ampules, said entry means having a delivery means and said ultrasonic waves being created by a vibratory apparatus positioned adjacent to said delivery means.

3. An apparatus as claimed in claim 2, further wherein said means for separating and conveying said ampules, further includes tong means, means for rotating said tong means in an arcuate path, said tong means being disposed whereby during the course of their rotation they are at least partially submerged in said water bath and subjected to ultrasonic waves.

4. An apparatus as claimed in claim 2, further wherein said delivery means is arranged to extend partially into said water bath and said separating and conveying means includes a fully submerged means which separates said ampules from each other so that they move seriatim through said water bath and transfer means arranged to receive individual ampules and traverse them through a serpentine path extending in a vertical plane so that said ampules move up and down in said water bath.

5. An apparatus as claimed in claim 3, further wherein said delivery means is arranged to extend partially into said water bath and said separating and conveying means includes a fully submerged means which separates said ampules from each other so that they move seriatim through said water bath and transfer means arranged to receive individual ampules and traverse them through a serpentine path extending in a vertical plane so that said ampules move up and down in said water bath.

6. An apparatus as claimed in claim 2, further wherein said delivery means is provided with a water shower swingably mounted thereon for the purpose of rinsing and filling the containers.

7. An apparatus as claimed in claim 3, further wherein said delivery means is provided with a water shower swingably mounted thereon for the purpose of rinsing and filling the containers.

8. An apparatus as claimed in claim 4, further wherein said delivery means is provided with a water shower swingably mounted thereon for the purpose of rinsing and filling the containers.

* * * * *